United States Patent [19]

Leuthesser

[11] Patent Number: 4,459,587

[45] Date of Patent: Jul. 10, 1984

[54] MOTORIZED CHARACTER ROTATION DEVICE AND METHOD OF SELECTIVE ACTUATION

[75] Inventor: Fred W. Leuthesser, Knoxville, Tenn.

[73] Assignee: Benco Industries, Inc., Ft. Deposit, Ala.

[21] Appl. No.: 321,720

[22] Filed: Nov. 16, 1981

[51] Int. Cl.[3] ..... G09G 3/04

[52] U.S. Cl. ..... 340/815.09; 340/706; 340/764

[58] Field of Search ..... 340/815.08, 815.09, 340/764, 807, 806, 763, 783, 319, 706

[56] References Cited

U.S. PATENT DOCUMENTS

| | | | |
|---|---|---|---|
| 783,082 | 2/1905 | Simmons . | |
| 1,706,876 | 3/1929 | Dunn . | |
| 2,426,079 | 8/1947 | Bliss | 177/337 |
| 2,779,016 | 1/1957 | Snell | 340/815.09 |
| 2,922,983 | 1/1960 | Sack, Jr. | 340/324 |
| 3,096,594 | 7/1963 | Skrobisch | 40/28 |
| 3,149,430 | 9/1964 | Szabo et al. | 340/815.08 |
| 3,273,270 | 9/1966 | Skrobisch | 40/52 |
| 3,307,170 | 2/1967 | Aoyama et al. | 340/815.08 |
| 3,399,475 | 9/1968 | Rinder | 40/28 |
| 3,638,217 | 1/1972 | Sutherland | 340/807 |
| 3,758,978 | 9/1973 | Miller | 40/130 E |
| 3,782,015 | 1/1974 | Ashton et al. | 40/130 |
| 3,866,216 | 2/1975 | Tschumi | 340/815.09 |
| 3,945,001 | 3/1976 | Shimakawa | 40/28 |
| 4,024,532 | 5/1977 | Sherwin | 340/336 |
| 4,040,193 | 8/1977 | Matsuda | 40/28 |
| 4,110,925 | 9/1978 | Strand et al. | 40/466 |
| 4,117,478 | 9/1978 | Skrobisch | 340/815.08 |
| 4,178,575 | 12/1979 | Ono | 340/764 |
| 4,344,070 | 8/1982 | Forest et al. | 340/764 |
| 4,394,652 | 7/1983 | Rabette | 340/764 |

*Primary Examiner*—Marshall M. Curtis
*Attorney, Agent, or Firm*—Luedeka & Neely

[57] ABSTRACT

A motorized character rotation device is provided which comprises a base, a synchronous motor, a rotation member and a character portion. The character portion is secured to the rotation member, which is reversibly rotatable by the motor through an angle of at least 90 degrees to expose a first surface of the character portion at one limit of the angle and to hide the first surface from view at a second limit of the angle. The character portion is secured in position when the synchronous motor is de-energized. A plurality of the character portions comprise one or more complete characters to define a displayed message. An electrical circuit and a method are provided to remotely select and actuate any character portion of the character display system.

5 Claims, 6 Drawing Figures

18
32
86
90
104
120
88
116
114
118
102
92
94
96
95
100
98
110
106
108
112
30
82
80
78
76
48
66
70
56
74
72
44
50
38
42
46
68
52
36
40

MOTORIZED CHARACTER ROTATION DEVICE AND METHOD OF SELECTIVE ACTUATION

The present invention relates generally to character display systems and specifically to motorized rotation devices selectively actuated to position character portions to define displayed characters.

A character display system commonly consists of a prominent mounting surface, a plurality of characters proximate the mounting surface, each character being defined by a plurality of character portions, a means for varying the character portions displayed to define a message.

A problem encountered with character display systems is that the displayed message is difficult, inconvenient and expensive to vary. Character display systems are often used to advertise prices, such as for gasoline, which are changed frequently. To compound this problem, in an application such as an interstate highway sign, the characters are often mounted on a high mounting surface to be seen from a distance. In some cases the signs are one-hundred feet high. Thus, not only must such a sign be changed frequently, but access to the mounting surface is both dangerous and cumbersome for operating personnel. Each time an operator climbs to the mounting surface, additional and unnecessary wage costs are incurred. Prior systems have not adequately solved the problems involved in changing the characters.

In one character display system, the characters comprise plates that must be physically attached to and removed from the mounting surface each time a change is required. This non-automatic system is clearly subject to all the defects discussed above.

One means of alleviating the problem of operator access is to use a plurality of electric light bulbs for character portions. The light bulbs are selectively energized or de-energized to define characters. This design, however, is defective since the light bulbs frequently burn out and must be replaced in the same unsatisfactory manner as the non-automatic design.

In another prior system each character is defined by seven rotatable character segments which cooperatively define a figure eight. Each segment is provided with a permanent magnet. An electrical coil mounted adjacent to each segment develops a magnetic circuit through two magnetizable metal bars extending therefrom to locations proximate opposite sides of the permanent magnet attached to each rotatable character portion. When the coil is energized in one direction, the two bars become magnetic with opposite polarities and attract opposite poles of the permanent magnet, rotating the character portion to an advanced position. The coil is then de-energized, and the character portion remains in its advanced position. When the coil is energized in a second direction, the polarity of the two bars is reversed, repelling like poles of the permanent magnet to rotate the character portion to a retracted position. The coil is de-energized, and the character portion similarly remains in its retracted position. This magnet display system is capable of being electrically actuated from a location remote to the mounting surface. However, the magnetic system has not adequately solved the problems associated with changing the characters. Magnetic systems require D.C. current and the development of D.C. current from A.C. through diodes has not proven effective for such systems.

The magnetic display system has not proven successful at changing the characters on a large sign, such as those used along interstate highways. The problem is that a large character portion, e.g. up to three feet long, is required for the message to be visually perceived from a distance. The relatively large mass of such a character portion presents a substantial inertial resistance to movement. The magnetic force between the two metal bars and the poles of the permanent magnet is inadequate to overcome the inertia of the large character portion.

Another problem with a magnetic display system is that the character portions tend to bounce when they are rotated to a new position and encounter a stop. The free rotation, which is used to overcome the weakness of a magnet system, permits such bouncing.

Energy usage is a problem with many character display devices. Since the electric light bulb design requires continuous use of electricity for the characters being displayed, it is highly energy inefficient and costly to operate. The non-automatic system and the magnetic system, although arguably energy efficient, are inadequate for the reasons previously given. Further, it is desirable to limit the amount of power being used at any given time.

Still another important feature of character display systems is the amount of maintenance required. Maintenance at the sign level of an elevated system is as costly as changing characters. Complex mechanical systems generally require more frequent maintenance.

It is thus an object of the present invention to provide an improved character display system. It is also an object to provide improved means for rotating and then impeding motion of a character portion. A further object is to provide an electrical system and a method of remote actuation of a character display system which is energy efficient and uses a minimum of components. Another object is to provide a character rotation device capable of rotating large character portions. Further objects and advantages will become aoparent through reference to the description and accompanying drawings in which:

Generally, in accordance with the present invention, each character portion of a plurality of characters is provided with a synchronous motor mounted on a stationary base. A rotation member is pivotally attached at one end to the base and at an opposite end is secured to an output shaft of the synchronous motor. The corresponding character portion is secured to the rotation member. The rotation member is rotatable by the motor through an angle of 90 degrees or more to expose one surface of the character portion at one limit of the angle and to hide that surface from view at a second limit of the angle. The character portion is mechanically impeded from rotating when the synchronous motor is de-energized. The synchronous motor of each character portion is selectively actuated through an electrical circuit. A plurality of these character portions comprise one or more complete characters to define a displayed message.

Figure 1:
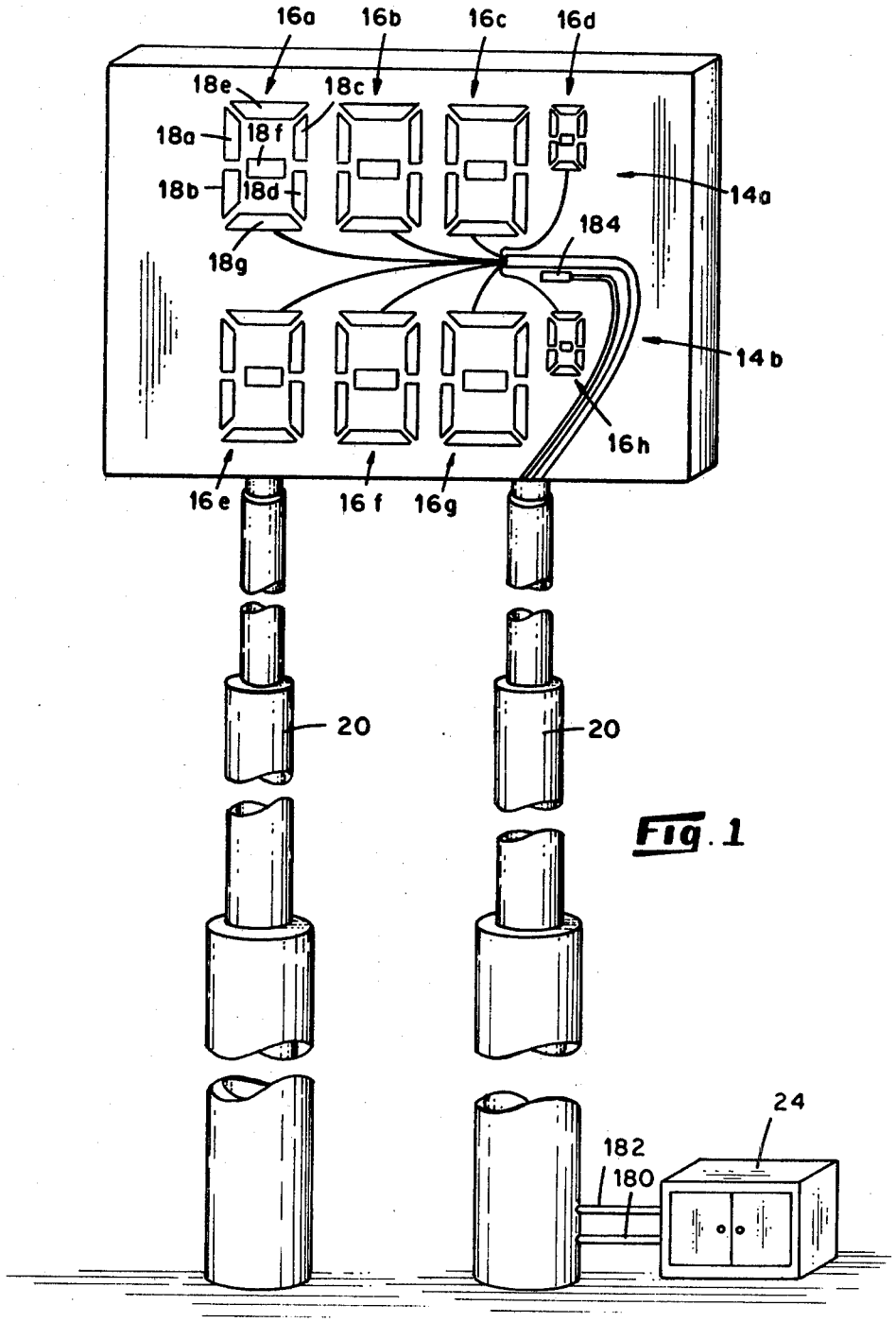
FIG. 1 is a perspective view of a sign displaying a system of characters.

Referring to the drawings, there is depicted in FIG. 1 a character display system including a prominent mounting surface 12 proximate one or more characters 16, each comprising a plurality of character portions 18. In the embodiment illustrated four characters, respectively designated 16*a*, 16*b*, 16*c* and 16*d*, are disposed in proximity to each other to comprise a first fuel price 14*a*, and four characters, respectively designated 16*e*, 16*f*, 16*g* and 16*h*, are disposed in proximity to each other to comprise a second fuel price 14*b*. Further, in the illustrated embodiment each character 16 comprises seven character portions, respectively designated 18*a*, 18*b*, 18*c*, 18*d*, 18*e*, 18*f* and 18*g*. The characters 16*d* and 16*h* are shown smaller than the other characters.

The mounting surface 12 is supported by a pair of columns 20, extending from ground level. A control panel 24 is disposed remote to the mounting surface 12 and proximate to the ground level.

Figure 2:
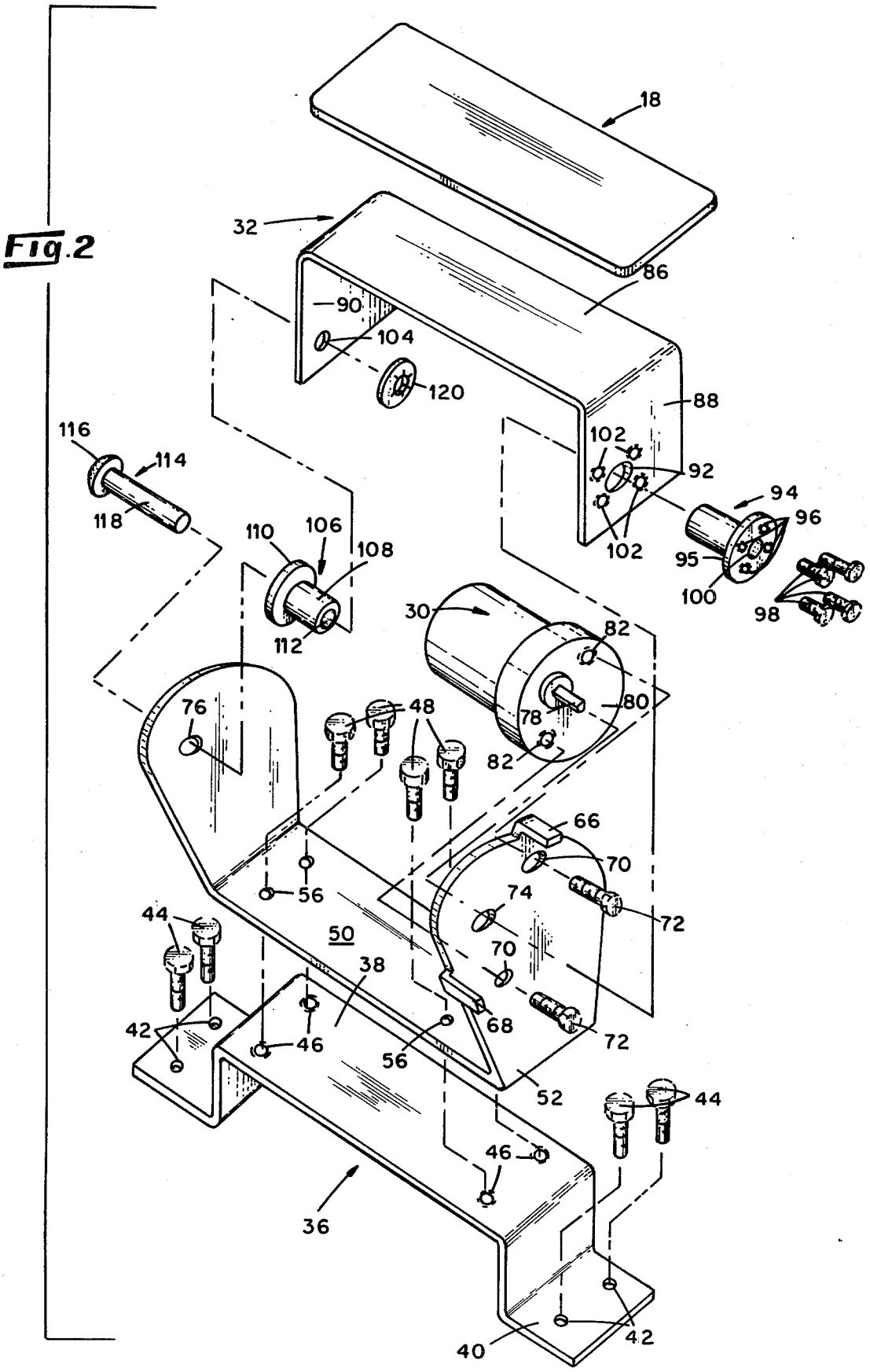
FIG. 2 is an exploded perspective view of a motorized character rotation device embodying various features of the present invention.
Figure 3:
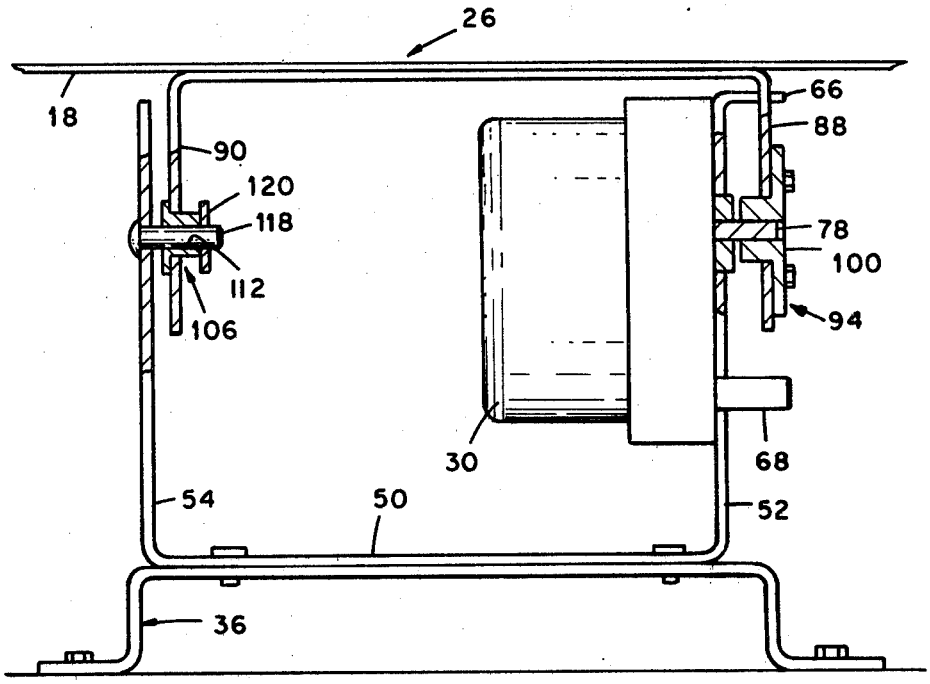
FIG. 3 is a side elevation view, partly in section, of the motorized character rotation device shown in FIG. 2.
Figure 4:
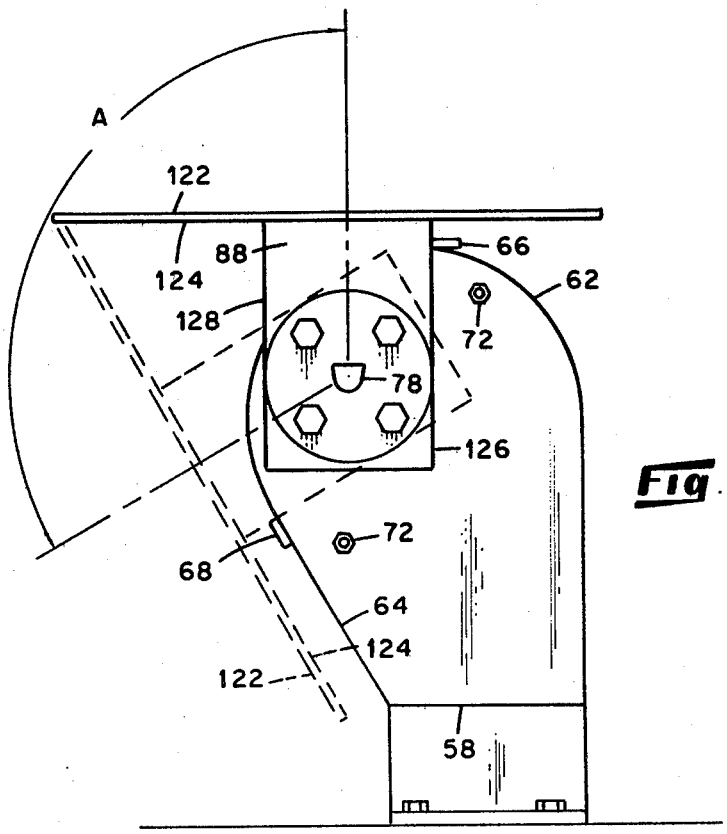
FIG. 4 is a front elevation view of the motorized character rotation device shown in FIG. 2.

FIGS. 2, 3 and 4 depict a motorized character rotation device 26 comprising an elongated base 28, a synchronous motor 30, a rotation member 32 and the character portion 18. An elongated mounting bracket 36 is provided to receive thereupon the character rotation device 26. In an alternate embodiment, it is understood that the base 28 and the mounting bracket 36 are integrally formed.

The mounting bracket 36 comprises a planar central portion 38 and two depending L-shaped end sections 40. The end sections 40 each define a plurality of holes 42 adapted to receive therethrough a corresponding number of screws 44 attaching the bracket 36 to the mounting surface 12. The central portion 38 is rectangular in shape and defines a plurality of threaded holes 46 adapted for mating engagement with a like number of screws 48.

The base 28 is generally U-shaped, comprising a planar central portion 50, a first end portion 52 attached at one end of the central portion 50 and extending substantially perpendicular thereto, and a second end portion 54 similarly attached to the opposite end of the central portion 50. The central portion 50 is rectangular in shape and defines a plurality of holes 56 sized to receive therethrough the threaded ends of the screws 48 for attachment of the base 28 to the mounting bracket 36. As depicted in FIG. 4, each of the end portions 52 and 54 has a linear first edge 58 that is substantially parallel to a transverse axis of the central portion 50, a linear second edge 60 extending perpendicularly from the first edge 58, an arcuate third edge 62 that extends from the edge 60 through an angle of approximately 210°, and a linear fourth edge 64 that extends between the first and third edges at an angle of approximately 120° to the first edge 58. The end portions 52 and 54 are shaped to permit actuation of the motorized character rotation device 26 without interference between its parts.

The first end portion 52 of the base 28 includes a first ear 66 attached to the arcuate third edge 62 and extending away from both end portions 52 and 54 in a direction substantially parallel to the longitudinal axis of the central portion 50. A second ear 68 is attached to the fourth edge 64 of the first end portion 52 and extends in substantially the same direction as the first ear 66. The first end portion 52 defines a pair of holes 70 sized to receive therethrough the threaded ends of a pair of screws 72. The holes 70 are disposed along a line which passes through the radial center for the arcuate edge 62 and which is inclined upward to the right as viewable in FIG. 4. The first end portion 52 further defines a hole 74, which is disposed upward and to the left of the radial center of the arcuate edge 62.

The second end portion 54 of the base 28 defines a hole 76 disposed along a line extending from the hole 74 parallel to the longitudinal axis of the central portion 50. The holes 74 and 76 define an axis of rotation about which the character portion 18 and the rotation member 32 are free to rotate.

The synchronous motor 30 includes at its longitudinal end an output shaft 78 and a face 80. The face 80 defines a pair of threaded holes 82, each of which is sized for mating engagement with a screw 72 to provide means for attaching the motor 30 to the base 28. The output shaft 78 is D-shaped in cross-section and extends longitudinally from a cylindrical shoulder 84 projecting from the face 80. The diameter of the cylindrical shoulder 84 is substantially equal to the diameter of the hole 74 in the first end portion 52. The relative locations of the threaded holes 82 and the shoulder 84 correspond to the relative locations of the holes 70 and 74 whereby the shaft 78 extends outwardly through the hole 74 when the motor 30 is secured to the end portion 52.

The rotation member 32 is generally U-shaped comprising a rectangular central portion 86, a first end portion 88 and a second end portion 90, each of said end portions being attached to an opposite end of the central portion 86 and extending therefrom in a substantially perpendicular direction.

The first end portion 88 provides means for attaching the rotation member 32 to the output shaft 78 of the synchronous motor 30. The first end portion 88 defines an aperture 92 adapted to receive therein the shank of a flanged coupling 94. The flanged coupling 94 includes a flange 95 defining a plurality of holes 96 adapted to receive therethrough the threaded portions of a like plurality of screws 98. The flanged coupling 94 further defines a D-shaped central cavity 100, extending the entire length of the coupling and sized in cross-section substantially equivalent to the output shaft 78 of the synchronous motor 30. The first end portion 88 further defines a plurality of threaded holes 102 adapted to mate with the screws 98 to secure the flanged coupling 94 to the rotation member 32.

The second end portion 90 of the rotation member 32 is adapted to be pivotally attached to the second end portion 54 of the base 28. The second end portion 90 defines an aperture 104 disposed along a line extending from the hole 92 in a direction substantially parallel to the longitudinal axis of the central portion 86. A bushing 106, comprising a flange 110 and a sleeve 108 attached thereto, is adapted to pass through and provide a frictional fit with the hole 104. The bushing 106 defines a centrally-disposed longitudinal bore 112. A pin 114, comprising a head 116 and a shaft 118 attached to the head and extending therefrom, is sized to frictionally engage the aperture 76 and to engage the bore 112 in sliding fit, enabling the rotation member 32 to rotate freely about the shaft 118. A fluted nut 120 is provided for locking engagement of the shaft 118 after passage through the bore 112.

The character portion 18 is a flat plate and is attached, as by glue or screws to the central portion 86 of the rotation member 32.

To assemble the motorized character rotation device 26, the face 80 of the synchronous motor 30 is positioned in proximity to the first end portion 52 of the base 28. The cylindrical shoulder 84 is urged longitudinally into the hole 74, and the threaded holes 82 are rotated into alignment with the holes 70. The threaded portions of the screws 72 pass through the holes 70 and engage the threaded holes 82, securing the motor 30 to the first end portion 52. The shaft 118 of the pin 114 is pressed into the aperture 76 until the head 116 is disposed in contact with the second end portion 54. The sleeve 108 of the bushing 106 is pressed into the aperture 104 until the flange 110 is disposed against the second end portion 90. The shank of the flanged coupling 94 is inserted into the aperture 92. The screws 98 are passed through the holes 96 to engage the threaded holes 102, thereby securing the flanged coupling 94 to the first end portion 88. As viewed in FIG. 3, the end portions 88 and 90 of the rotation member 32 are positioned to the right of the end portions 52 and 54, respectively, of the base 28. The D-shaped central cavity 100 is aligned with the D-shaped output shaft 78. Simultaneously, the bore 112 is longitudinally aligned with the shaft 118. The rotation member 32 is moved to the left as viewable in FIG. 3, urging the shafts 78 and 118 into the cavity 100 and the bore 112, respectively. The shaft 118 extends through the bushing 106, and the fluted nut 120 is placed on the end of the shaft 118 to restrain the rotation member 32 from substantial axial movement relative to the base 28 and the motor 30. When assembled, the first end portion 88 is longitudinally disposed between the first portion 52 and the end of each ear 66 and 68. The first end portion 88 is transversely disposed between the ears 66 and 68.

Once the motorized character rotation device 26 is assembled, it is secured to mounted onto the mounting bracket 36. The threaded ends of the screws 48 are passed through the holes 56 to mate with the threaded holes 46. The mounting bracket 36 is attached to the mounting surface 12, as by screws 44 passing through holes 42.

FIG. 4 best illustrates the operation of the character rotation device 26. In an advanced position, shown in solid lines, a first surface 122 of the character portion 18 is disposed substantially parallel to and facing away from the mounting surface 12. An opposed second surface 124 faces toward the mounting surface 12. The character portion 18 is sized such that only the first surface 122 is substantially visable from a point above the motorized character rotation device. The advanced position is determined by the abutment of the ear 66 against a first side wall 126 of the end portion 88. In a retracted position, shown in dashed lines, the surfaces 122 and 124 are disposed at an angle of approximately 120° with respect to the mounting surface 12. The edges 64 are disposed at an obtuse angle of approximately 120 degrees relative to the edges 58, to provide clearance for the character portion 18 to rotate to its retracted position. In the retracted position, the first surface 122 is entirely hidden from view from a point above the motorized character rotation device, whereas the second surface 124 is partially exposed. The motor 30, the rotation member 32, the base 28 and the mounting bracket 36 are also exposed when the character rotation device is in a retracted mode. Abutment of the ear 68 against a second side wall 128 of the end portion 88 determines the retracted position.

Means are provided to visually distinguish the mounting surface 12 from the first surface 122 in the advanced position. Similarly, the second surface 124, the motor 30, the rotation member 32, the base 28 and the mounting bracket 36 are adapted to visually blend in the retracted mode with the mounting surface 12. In one embodiment, this is accomplished by painting the surface 122 a white or light color and by painting everything else a black or dark color. Thus, although exposed to view when the character rotation device is in the retracted mode, the motor 30, the rotation member 32, the base 28, the mounting bracket 36 and the second surface 124 are not visually perceptible to a viewer at a location spaced from the mounting surface.

Means are provided to rotate the character portion 18 between the advanced and retracted positions and to impede rotation of the character portion 18 in either of said positions. The synchronous motor 30 is adapted for reversible rotation. When the motor 30 is energized to produce counter-clockwise rotation of the output shaft 78, as viewed in FIG. 4, the torque is transmitted through the D-shaped cavity 100 of the coupling 94 to the rotation member 32. The torque is then transmitted to the bushing 106 by the second end portion 90. The rotation member 32 and the attached character portion 18 are free to rotate about an axis defined by the co-axial shafts 78 and 118, due to the sliding fit between the bushing 106 and the shaft 118. The rotation member 32 rotates counter-clockwise through an angle A to define the retracted position shown in dashed lines in FIG. 4. The ear 68 contacts the side wall 128, and the counter-clockwise torque of the motor 30 is successfully opposed by the structural rigidity of the base 28. Thus, the rotation does not proceed beyond the retracted position. The motor 30 is then de-energized. The character portion 18 is held in its retracted position due to the frictional resistance of the internal bearings and gearing of the synchronous motor 30.

When the motor 30 is energized to produce clockwise rotation of the output shaft 78, the character portion 18 and the rotation member 32 are rotated clockwise in similar fashion through the angle A to define the advanced position shown in solid lines in FIG. 4. Clockwise rotation is ceased at the advanced position by the ear 66 coming into contact with the side wall 126 to oppose the torque of the motor 30. The motor 30 is then deenergized. The character portion 18 is locked in its advanced position due to the frictional resistance of the internal bearings and gearing of the synchronous motor 30.

In one embodiment, the motor 30 comprises an electrically reversible, model K81421 synchronous motor, available from North American Philips Controls Corporation and rated to provide an output speed of 30 r.p.m. and a synchronous torque of 13.3 oz.-in. with a nominal rotor torque of 2 oz.-in. The synchronous motor is fully capable of rotating and holding large character portions defining characters such as the following. In one embodiment, the character **16*a* is approximately ten inches wide by thirty inches long, and the character 16*d* is approximately eight inches wide by thirty inches long. The mounting surface 12**, in one embodiment, is disposed approximately 54 feet above ground level. The angle A is approximately 120 degrees.

Each of the character portions in the character display system illustrated in FIG. 1 is rotatable by a corresponding motorized character rotation device 26 to define the displayed characters 16*a–h*. Each character rotation device is oriented so that a clockwise rotation advances the respective character portion and a counter-clockwise rotation retracts the respective character portion. It is understood that the character rotation device 26 may be arranged opposite from that depicted in FIGS. 2–4, whereby clockwise rotation retracts the character portion 18 and counter-clockwise rotation advances the character portion 18.

It is apparent that each of the character portions in FIG. 1 is disposed in an advanced position, each defining the character "eight". It is understood that selective retraction of character portions can define other characters. For example, retraction of the character portion 18*b* of the character 16*a* and advancement of the remaining character portions of the character 16*a* defines a character "nine". It is further understood that the character portions, in addition to comprising numerical characters, may comprise characters such as letters, symbols or graphical representations.

Figure 5:
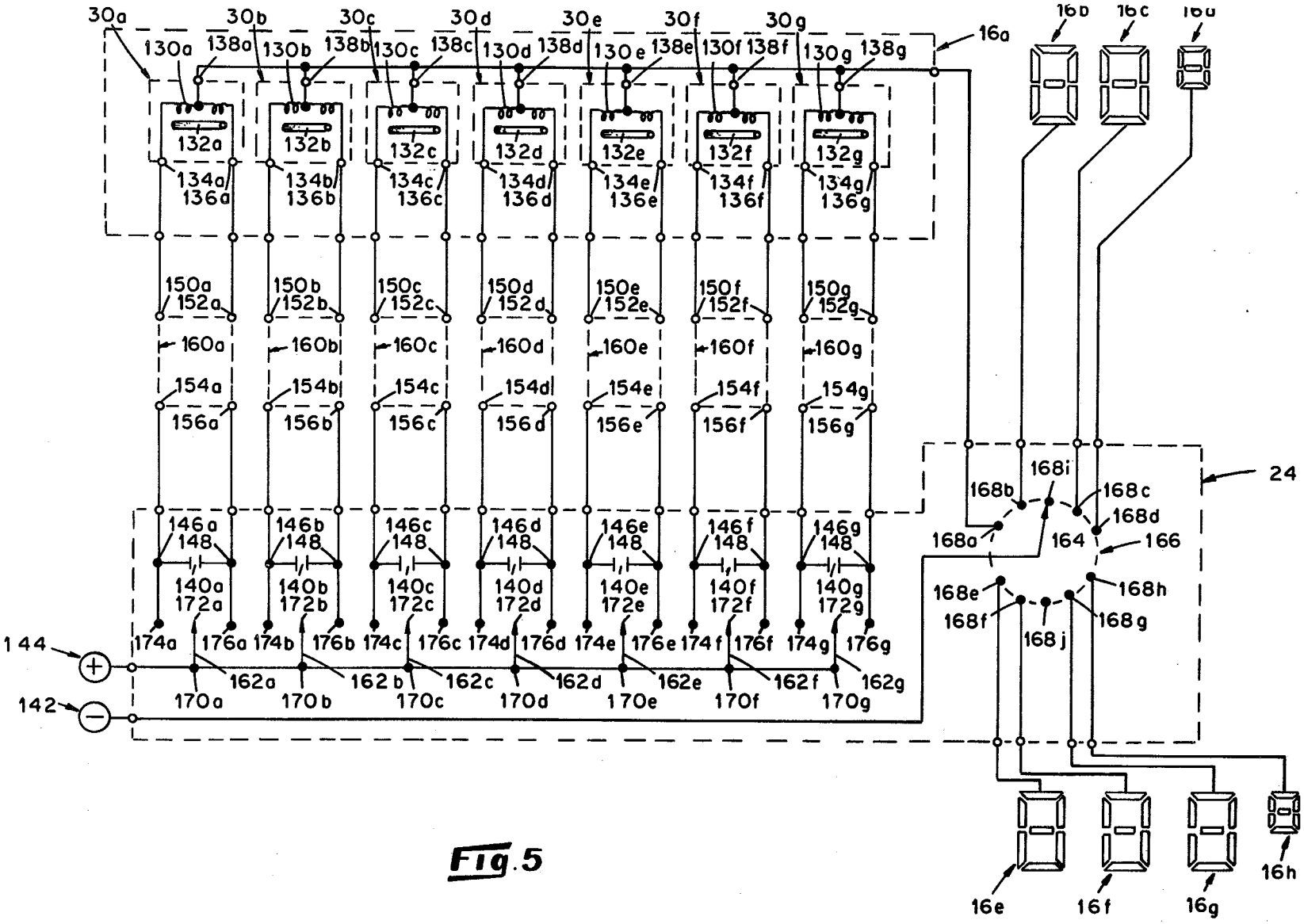
FIG. 5 is a schematic diagram of an electric circuit adapted to actuate a plurality of the motorized character rotation devices shown in FIG. 2; and, FIG. 6 is a schematic diagram of a portion of the electric circuit shown in FIG. 5.

An electrical system is provided to remotely actuate the character display system. In FIG. 5, the character 16*a* is represented schematically by dashed lines. The character 16*a* includes seven synchronous motors 30*a–g* corresponding to the character portions 18*a–g*, respectively. The motor 30*a* includes a coil 130*a* and a rotor 132*a*. The coil 130*a* has a first end 134*a*, a second end 136*a* and an intermediate point 138*a*. The rotor 132*a* is connected through internal gearing (not shown) to the output shaft 78 for the character portion 18*a* of the character 16*a*. Each of the characters 16*b–h* include similar synchronous motors 30*a–g*. Since the circuits within the characters 16*b–h* are substantially the same as that within the character 16*a*, they are not shown in detail in FIG. 5.

The control panel 24 is schematically depicted by dashed lines in FIG. 5. The switching means to actuate the character portions are contained within the control panel 24, which is disposed remote to the characters 16*a–h* and proximate to ground level. Thus, the need for access to the mounting surface 12 by operating personnel is minimized or eliminated. Moreover only a single eight-wire cable and a fourteen-wire cable are required to interconnect the control panel and the remote sign.

A ten position rotary switch 166 is disposed within the control panel 24 to provide means for selective actuation of any of the characters 16*a–h*. A first pole 142 of a source voltage is wired in electrical connection with an input terminal 164 of the first switch 166 and is shown negative in FIG. 5. Two output terminals 168*i* and 168*j* of the first switch 166 have no external connections, thus defining two electrically-isolated off positions. An output terminal 168*a* of the switch 166 is wired in parallel electrical connection with the intermediate points 138*a–g* of the coils 130*a–g* associated with the character 16*a*. In similar fashion, each of a plurality of output terminals 168*b–h* of the first switch 166 is wired to the characters 16*b–h*, respectively. The switch 166 is able to transmit the voltage at its input terminal 164 to only one variably-selected output terminal, and thus only one character of the mounting surface 12, at any given time.

A plurality of second switches 162*a–g* is disposed within the control panel 24 and provides means for selectively rotating clockwise or counter-clockwise each character portion of a character selected by the first switch 166. In the illustrated embodiment, each of the second switches 162*a–g* corresponds to a similarlydesignated character portion 18*a–g* of a selected character 16, and only seven switches 162 are used in order to minimize the number and cost of electrical components. A second pole 144 of the source voltage is shown positive in FIG. 5 and is wired in parallel electrical connection with a plurality of input terminals 170*a–g* of the second switches 162*a–g*, respectively. The second switch 162*a* includes an electrically-isolated output terminal 172*a* that defines an off position. A first output terminal 174*a* and a second output terminal 176*a* of the second switch 162*a* are available for transmitting voltage received at the input terminal 170*a*. Similarly, the second switches 162*b–g* include the output terminals 172*b–g*, 174*b–g* and 176*b–g*. In one embodiment, each of the second switches 162*a–g* comprises a double-acting, momentarily-on toggle switch, which is spring biased toward the off position. The use of momentarily-on toggle switches assures that the character display system 10 will return to a de-energized mode after the characters are changed, thereby minimizing energy usage.

A plurality of capacitors 140*a–g* are provided within the control panel 24 to start, respectively, the synchronous motors 30*a–g* associated with a character selected by the first switch 166. In the depicted embodiment, only seven capacitors are used in order to minimize the number and cost of electrical components for the display system 10. The first end 146*a* of the capacitor 140*a* is electrically connected to the first output terminal 174*a* of the second switch 162*a*. The second end 148*a* of the capacitor 140*a* is electrically connected to the second output terminal 176*a* of the second switch 162*a*. In similar fashion, the ends of the capacitors 140*b–g* are electrically connected to the output terminals of the second switches 162*b–g*.

In one embodiment, the capacitors 140*a–g* are rated at 120 volts, 60 hertz and 0.22 micro-farads. These capacitors provide sufficient starting torque to the synchronous motors to initiate rotation of the large character portions previously described.

Figure 6:
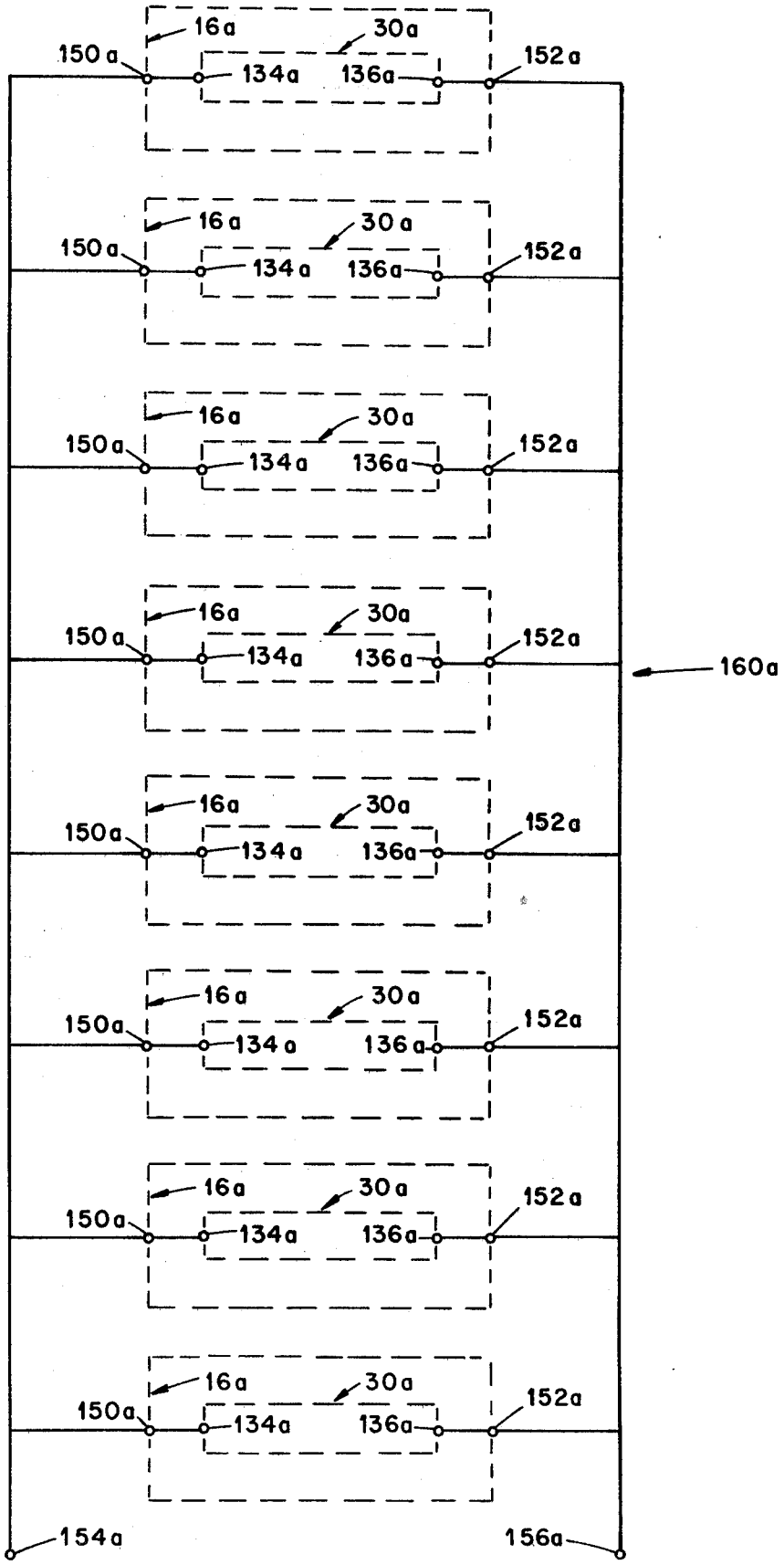

Referring to FIGS. 5 and 6, a parallel circuit 160*a* is provided to simultaneously connect the second pole 144 to either the first end 134*a* or the second end 136*a* of the coil 130*a* of each of the characters 16*a–h*. The first end 146*a* of the capacitor 140*a* is electrically connected to a first end 154*a* of the parallel circuit 160*a*, and the second end 148*a* of the capacitor 140*a* is electrically connected to a second end 156*a* of the parallel circuit 160*a*. Each of a plurality of third ends 150*a* of the parallel circuit 160*a* is wired in parallel electrical connection to the first end 134*a* of the coil 130*a* of each of the characters 16*a–h*. Similarly, each of a plurality of fourth ends 152*a* of the parallel circuit 160*a* is wired in parallel electrical connection to the second end 136*a* of the coil 130*a* of each of the characters 16*a–h*. For illustrative convenience, FIG. 6 does not depict electrical connections for the intermediate points 138*a* of the coils 30*a* associated with the characters 16*a–h*. In similar fashion, the capacitors 140*b–g* are electrically connected through respective parallel circuits 160*b–g* to the respective coils 130*b–g* of the characters 16*a–h*.

As illustrated in FIG. 5, the first switch 166 and the second switches 162*a–g* are disposed in the off positions. Thus, the character display system 10 is shown in a non-actuated mode.

As noted hereinabove, a single eight-wire cable 180 extends from the control panel 24, and more particularly the rotary switch 166, to the mounting surface 12. Each of the eight wires in the cable 180 is connected to the intermediate points 138*a–g* of one of the eight characters 16*a–h* on the mounting surface 12. A single fourteen-wire cable 182 extends from the control panel 24, and more particularly the seven toggle switches 162*a–g*, to a fourteen-position pin plug connector 184 secured to the mounting surface 12. Parallel connections (not shown) are made between the connector 184 and each of the characters 16*a–h*.

It will be recognized that corresponding characters on an opposing side of the mounting surface can be operated simultaneously with the characters 16*a–h* on the mounting surface by corresponding connection to the cable 180 and parallel connection to the connector 184.

In operation, to rotate a desired character portion, such as the portion 18*a* of the character 16*a*, the first switch 166 is rotated to the desired character. Thus, the first pole 142 of the source voltage is connected through the input terminal 164 to the output terminal 168*a*. From the terminal 168*a*, the first pole 142 is connected to each of the intermediate points 138*a–g* of the coils associated with the character 16*a*. Whether the character portion 18*a* is rotated clockwise or counter-clockwise is determined by the particular direction in which the second switch 162*a* is actuated.

When the second switch 162*a* is actuated in a first direction, the input terminal 170*a* is electrically connected to the first output terminal 174*a*. The second pole 144 of the voltage source is thus placed in electrical connection with the first end 134*a* of the coil 130*a* associated with the character 16*a*. The capacitor 140*a* provides a starting torque sufficient to initially rotate the rotor 132*a* relative to the coil 130*a* of the character 16*a*, causing the rotor current to lag the induced electromotive force. A rotating magnetic field is thus established, causing the rotor 132*a* of the character 16*a* to rotate in a first direction. The character portion 18*a* of the character 16*a* also rotates in the first direction, since it is connected to the rotor 132*a* by the rotation member 32, the output shaft 78 and the internal gearing of the motor. Depending on the relative configuration of the coil, the gearing and the voltage source, the rotation in the first direction will be either clockwise or counter-clockwise. In the depicted embodiment, the configuration is chosen so that the character portion 18*a* of the character 16*a* rotates clockwise when the second switch 162*a* is actuated toward the output terminal 174*a*. It is understood that the character portions 18*a* of the characters 16*b–h* are not actuated, because the first switch 166 is set at the output terminal 168*a*. It is further understood that any of the character portions 18*b–g* of the character 16*a* may be rotated clockwise by similar actuation of the second switches 162*b–g*.

When the second switch 162*a* is actuated in a second direction, the input terminal 170*a* is electrically connected to the second output terminal 176*a*. The second pole 144 of the voltage source is thus placed in electrical connection with the second end 136*a* of the coil 130*a* associated with the character 16*a*, providing counter-clockwise rotation of the character portion 18*a* of the character 16*a* once the capacitor 140*a* has provided starting torque. It is understood that any of the character portions 18*b–g* of the character 16*a* may be rotated counter-clockwise by similar actuation of the second switches 162*b–g*.

In the illustrated embodiment, only the motors of one character are simultaneously energized, thus minimizing the energy usage at any given time by a careless operator. Further protection may be provided by orienting the switches so that they pivot within a common plane, for example.

The present invention provides an improved character display system in which each character portion is secured to a rotation member reversibly rotated by a synchronous motor. The internal bearings and gearing of the motor impede rotation to hold the character portion in position when the motor is de-energized, providing energy efficiency and improved stability of the character portions. The synchronous motor directly rotates large character portions. An electrical system with a minimum of components is provided to actuate the character display system in an energy-efficient manner.

While a preferred embodiment has been shown and described, it will be understood that there is no intent to limit the invention by such disclosure, but rather, it is intended to cover all modifications and alternate constructions falling within the spirit and scope of the invention as defined in the appended claims.

What is claimed is:

1. A character rotation device comprising a base, a reversible synchronous motor with reduction gearing attached to said base and having an output shaft, an elongated rotation member having a first end pivotally attached to said base and a second end secured for pivotal motion to said output shaft of said synchronous motor to define an axis for reversible rotation of said rotation member through an angle of 90 degrees or more, a character portion secured to said rotation member having a first surface, and abutment means to define at the respective limits of said angle an advanced position in which said first surface of said character portion is visible from a location spaced from said character rotation device and a retracted position in which said first surface is hidden from view from said spaced location, whereby the internal frictional and inertial resistance of said synchronous motor with gearing secures said rotation member in position when said synchronous motor is de-energized.

2. A motorized character rotation device as defined in claim 1 wherein said abutment means comprises a first ear attached to said base and extending therefrom to abut said rotation member when rotated into said advanced position and a second ear attached to said base and extending therefrom to abut said rotation member when rotated into said retracted position.

3. A motorized character rotation device as defined in claim 1 wherein said base is secured to a mounting surface, said first surface of said character portion is adapted to visually contrast with said mounting surface, and said base, said synchronous motor and said rotation member are adapted to visually blend with said mounting surface.

4. A character display system comprising:

a plurality of similar characters, each of said characters being defined by a plurality of character rotation devices in corresponding positions, each of said character rotation devices comprising a base, a reversible synchronous motor with reduction gearing attached to said base and having an output shaft, an elongated rotation member having a first end pivotally attached to said base and a second end secured for pivotal motion to said output shaft of said synchronous motor to define an axis for reversible rotation of said rotation member through an angle of 90 degrees or more, a character portion secured to said rotation member having a first surface, and abutment means to define at the respective limits of said angle an advanced position in which said first surface of said character portion is visible from a location spaced from said character rotation device and a retracted position in which said first surface is hidden from view from said spaced location, whereby the internal frictional and inertial resistance of said synchronous motor with gearing secures said rotation member in position when said synchronous motor is de-energized;

a control panel located remotely from said rotation devices;

a primary switch disposed within said control panel comprising a single input terminal connected to a first pole of a voltage source and plurality of a output terminals, each of said butput terminals being connected to all of said synchronous motors associated with a respective complete character, said primary switch being adapted to connect the first source voltage to all of said synchronous motors associated with only one variable-selected respective complete character at any given time;

a plurality of double-acting momentarily-on toggle switches disposed within said control panel, each of said toggle switches having an input terminal and two isolated output terminals, said input terminals of said toggle switches being connected to a second pole of said source voltage, each of said toggle switches having a first output terminal and a second output terminal, each of said toggle switches being adapted to selectively connect the second source voltage at said input terminal to only one of said first output terminal and said second output terminal;

a plurality of starting circuits each being connected to both said first output terminal and said second output terminal of one of the said plurality of toggle switches and being connected to all of said synchronous motors associated with all of said character rotation devices in only one of the corresponding positions of said characters;

each of said starting circuits being operable to start and run in a first direction one of said synchronous motors associated with said one variably-selected respective complete character connected to said first voltage source by said primary switch when said toggle switch connects said second source voltage to said first output terminal and to start and run said same synchronous motor in the opposite direction when said toggle switch connects said second source voltage to said second output terminal, whereby each rotation device is selectively rotatable from a remote location.

5. A system as defined in claim 4 wherein said primary switch comprises a rotary switch.

* * * * *